United States Patent [19]

Prairie

[11] Patent Number: 4,759,509

[45] **Date of Patent: * Jul. 26, 1988**

[54] SUPERMILL JOURNAL SPRING SYSTEM

[75] Inventor: Robert S. Prairie, West Hartford, Conn.

[73] Assignee: Combustion Engineering, Inc., Windsor, Conn.

[ * ] Notice: The portion of the term of this patent subsequent to Nov. 17, 2004 has been disclaimed.

[21] Appl. No.: 765,776

[22] Filed: Aug. 15, 1985

[51] Int. Cl.[4] ..... B02C 15/00

[52] U.S. Cl. ..... 241/121; 241/289; 267/137

[58] Field of Search ..... 241/117–121, 241/288–290, 287, 37, 101.2; 267/89, 137, 140.2, 136, 170, 172, 174–177, 179

[56] References Cited

U.S. PATENT DOCUMENTS 2,112,359 3/1938 Crites ..... 241/121 X
3,881,348 5/1975 Morton ..... 241/121 X

FOREIGN PATENT DOCUMENTS 11760 of 1905 United Kingdom ..... 241/121

*Primary Examiner*—Mark Rosenbaum
*Attorney, Agent, or Firm*—Arthur E. Fournier, Jr.

[57] ABSTRACT

A mechanical spring journal assembly (20) particularly suited for use in a bowl mill (10) of the type that is employed for purposes of effectuating therewithin the pulverization of material such as coal. It is through the operation of the subject mechanical spring journal assembly (20) tht there is established the magnitude of the forces which the grinding rolls (18) of the bowl mill (10) apply to the coal for purposes of accomplishing the pulverization of the coal. The subject mechanical spring journal assembly (20) includes spring housing means (44) comprising a self-contained subassembly unit for the operating components of the mechanical spring journal assembly (20), stud bearing means (38) attached to one end of the spring housing means (44), preload stud means (40) having one end thereof supported by the stud bearing means (38), pressure spring means (42) positioned in surrounding relation to the preload stud means (40) and adjustment means (46) operative for mounting the mechanical spring journal assembly (20) in the bowl mill (10).

3 Claims, 2 Drawing Sheets

SUPERMILL JOURNAL SPRING SYSTEM

CROSS-REFERENCE TO RELATED APPLICATIONS

This application is hereby cross-referenced to the following patent application which was commonly filed herewith and which is commonly assigned: U.S. patent application Ser. No. 765,976 filed Aug. 15, 1985 entitled "A RETROFITABLE COILED SPRING SYSTEM" and which was filed in the names of Robert S. Prairie and Frank J. Paskowski.

BACKGROUND OF THE INVENTION

This invention relates to apparatus for pulverizing, i.e., grinding, material, and more specifically to a coiled spring system that is particularly suited for embodiment in a bowl mill wherein the coiled spring system is operative for purposes of establishing the magnitude of the forces which the grinding rolls of the bowl mill exert on the coal for purposes of effectuating the pulverization of the coal.

An essential component of any steam generation system of the type, which utilizes pulverized coal as a fuel, is the apparatus in which the coal is pulverized so as to render it suitable for such usage. Although the prior art is known to have employed various types of apparatus for purposes of accomplishing coal pulverization, one form of apparatus in particular, which has frequently been used for this purpose, is that commonly referred to as a bowl mill by those in the industry. The bowl mill obtains its name principally from the fact that the pulverization, i.e., grinding, of the coal that takes place therewithin occurs on a grinding surface which in configuration somewhat resembles a bowl.

By way of illustration, reference may be had to U.S. Pat. No. 3,465,971 which issued Sept. 9, 1969 to J. F. Dalenberg et al. and which is assigned to the same assignee as the present invention for a showing of a prior art form of bowl mill. This patent contains a teaching of both the nature of the construction and the mode of operation of a bowl mill that is suitable for use for purposes of effectuating the pulverization of the coal that is used to fuel a coal-fired steam generator. As taught by this patent, the essential components of such a bowl mill are a body portion, i.e., housing, within which a grinding table is mounted for rotation, a plurality of grinding rolls that are supported in equally spaced relation one to another in a manner so as to coact with the grinding table such that the coal disposed on the surface of the grinding table is capable of being ground, i.e., pulverized, by the rolls, coal supply means for feeding to the surface of the grinding table the coal that is to be pulverized in the bowl mill, and air supply means for providing to the interior of the body portion the air that is required for the operation of the bowl mill.

In order to satisfy the demands of a coal-fired steam generation system of conventional construction for pulverized coal a multiplicity of bowl mills of the type shown in the aforereferenced patent are commonly required to be employed. Further in this regard, it is noted that the individual capacity of each of these bowl mills may range up to a capacity of one hundred tons of pulverized coal per hour. In addition to possessing a capability of operating at their maximum capacity, these bowl mills must also have the ability to operate at less than full capacity, i.e., at some percentage thereof, e.g., 25%, 50%, 75%, etc. Accordingly, this fosters a further requirement that the bowl mill be capable of exerting the requisite degree of grinding force regardless of the rate of output at which the bowl mill is operating. Here note is taken of the fact that variations in the output provided from the bowl mill are normally accomplished by varying the amount of coal that is fed to the grinding table, while the speed of rotation of the grinding table is made to remain substantially constant.

The depth of coal that is disposed on the grinding table is a function of the output rate at which the bowl mill is performing. In addition, the depth of coal that is present on the grinding table has an effect on the amount of grinding force being exerted on the coal by the grinding rolls. Obviously, therefore, it is important that if the grinding rolls are to apply the requisite degree of force needed to effect the pulverization of the coal, consideration must be given to the existence of this relationship between the grinding force exerted by the grinding rolls and the depth of coal on the grinding table.

The journal loading, which dictates the amount of grinding force that the grinding rolls exert on the coal, has heretodate been provided either through the use of hydraulic systems or through the use of mechanical springs. One such arrangement of mechanical springs can be found depicted, for example, in the patent which was referred to above previously. In accord with the showing contained in this U.S. patent, each grinding roll is urged towards the surface of the grinding table by means of an adjustable spring. To this end, there is selected for use for this purpose, a mechanical coil spring that possesses the design characteristics desired; namely, a spring that is capable of urging the grinding roll toward the grinding table surface in such a manner that the grinding roll exerts a predetermined grinding force on the coal disposed on the table, when the coal is of a predetermined depth on the table.

As an alternative to the use of mechanical coil springs for purposes of providing the journal loading, the prior art on occasion has turned to the employment of hydraulic systems. U.S. Pat. No. 4,002,299, which issued on Jan. 11, 1977 to C. J. Skalka and which is assigned to the same assignee as the present application, is directed to one arrangement of such a hydraulic system. In accord with the teachings of this patent, a system is provided wherein the grinding rolls have a hydraulic loading applied thereto. More specifically, the hydraulic loading on the grinding rolls is established by means of hydraulic fluid that is fed under pressure to the grinding rolls. Moreover, through the use of a servo system, changes in the hydraulic pressure are automatically effected as the mill output increases or decreases.

Notwithstanding the fact that hydraulic systems have been utilized heretofore for purposes of accomplishing the journal loading of the grinding rolls in a bowl mill, when so employed for this purpose such hydraulic systems and in particular such hydraulic systems that make use of a servo system have been known to be disadvantageously characterized. More specifically, reference is had here to the fact that a characteristic of the servo systems employed in connection with the establishment of the hydraulic loading on the grinding rolls in bowl mills is the susceptibility of such servo systems to the phenomenon known as hunting. Inasmuch as those skilled in the art of servo systems are well acquainted with this phenomenon, it is not deemed necessary to discuss it at length herein. Rather, it is deemed sufficient to merely note that hunting is that phenomenon wherein the servo system in its attempt to effect the establishment of the proper hydraulic pressure continually signals the need for minor corrective adjustments to be made in the hydraulic pressure. To this end, each time the servo system senses a deviation from the desired pressure level, it signals the need for corrective action to be taken. This corrective action instituted by the servo system in turn elicits from the latter the need for a further change. This process, which may go on ad infinitum, is what is referred to herein as the phenomenon of hunting.

In addition to being disadvantageously characterized by virtue of their susceptibility to hunting, as discussed above, the systems that have been suggested to date by the prior art for purposes of hydraulically loading the grinding rolls in a bowl mill have in general also suffered from a further disadvantage. Reference is had here to the fact that most, if not all, of the hydraulic systems that have been suggested for use by the prior art in connection with establishing the loading on the grinding rolls in a bowl mill are unsuitable for use for purposes of effecting changes in the amount of grindng force that the rolls exert. That is, the mode of operation of these prior art forms of hydraulic systems is such that they are intended to ensure that a fixed value of hydraulic pressure is continually applied to the grinding rolls in the form of the journal loading thereon.

The difficulty arises here from the fact that although a particular value of hydraulic pressure may be selected so as to cause the grinding rolls to exert the optimum amount of grinding force for a particular set of operating parameters, as the latter parameters vary in the course of the operation of the bowl mill, the value of the pressure of the hydraulic fluid being fed to the grinding rolls may not necessarily be the same as that which should be present to ensure that the grinding rolls are still exerting the optimum amount of grinding force under this changed set of operating parameters. Moreover, once the value of the pressure of the hydraulic fluid that is to be supplied to the grinding rolls is established, in accord with the mode of operation of most, if not all, of these prior art forms of hydraulic systems, this value for the hydraulic pressure cannot be changed. That is, changes cannot be effected in the established value for the pressure of the hydraulic fluid in accordance with the need to vary the amount of grinding force that the grinding rolls are required to exert in order to pulverize to the desired extent the coal that is disposed on the grinding table surface.

A need has thus existed in the prior art for a new and improved means, preferably of the mechanical spring type, for providing the journal loading on the grinding rolls of a bowl mill. Moreover, a need has been demonstrated for such a journal spring assembly which could be provided in the form of a completely subassembled unit that could be assembled, preloaded and stored as a spare part. In addition, a need has been shown for such a journal spring assembly which would not suffer from the same difficulties that have served to disadvantageously characterize the operations of bowl mills that have been equipped with prior art forms of mechanical coil spring journal assemblies such as the fact that such prior art forms of mechanical coil spring journal assemblies have demonstrated a susceptibility to being adversly affected by the operating conditions which exist within the bowl mill. Finally, a need has been evidenced in the prior art for such a journal spring assembly which in addition to embodying the beneficial attributes enumerated above would also be advantageously characterized by the fact that the subject journal spring assembly would be simpler in construction and easier to employ while yet being capable of providing reliable operation relatively inexpensively.

It is, therefore, an object of the present invention to provide a new and improved assembly operable for establishing the journal loading on the grinding rolls of a bowl mill that is suitable for use to pulverize coal.

It is another object of the present invention to provide such an assembly that is operative to establish a mechanical spring journal loading on the grinding rolls of a bowl mill that is suitable for use to pulverize coal.

It is still another object of the present invention to provide such a mechanical spring assembly for establishing the journal loading on the grinding rolls of a bowl mill which is characterized by the fact that the mechanical spring assembly can be provided in the form of a completely subassembled unit which can be assembled, preloaded and stored as a spare part.

A further object of the present invention is to provide such a mechanical spring assembly for establishing the journal loading on the grinding rolls of a bowl mill that is characterized by the fact that the spring portion thereof is suitably positioned such that minimal influence is exerted thereupon by the operating conditions which exist within the bowl mill.

A still further object of the present invention is to provide such a mechanical spring assembly for establishing the journal loading on the grinding rolls of a bowl mill which is characterized by the fact that the mechanical spring assembly is simpler in construction than prior art forms of mechanical spring journal assemblies.

Yet another object of the present invention is to provide such a mechanical spring assembly for establishing the journal loading on the grinding rolls of a bowl mill which is characterized by the fact that the mechanical spring assembly is easier to employ than prior art forms of mechanical spring journal assemblies.

Yet still another object of the present invention is to provide such a mechanical spring assembly for establishing the journal loading on the grinding rolls of a bowl mill which is characterized by the fact that the mechanical spring assembly is capable of furnishing reliable operation while yet being relatively inexpensive to provide.

SUMMARY OF THE INVENTION

In accordance with the present invention there is provided a mechanical spring assembly that is particularly suited for employment in a bowl mill of the type that is operative for purposes of effecting the pulverization therewithin of a material such as coal. The subject mechanical spring assembly is operative for purposes of establishing the journal loading on the grinding rolls of the bowl mill through the operation of which in turn the pulverization of the coal is accomplished within the bowl mill. The subject mechanical journal spring assembly includes stud bearing means, preload stud means, pressure spring means, spring housing means and adjustment means. The spring housing means is detachably secured to the journal opening cover of the bowl mill so as to be located substantially entirely to the exterior of the bowl mill and in juxtaposed relation to an opening with which the bowl mill is suitably furnished that provides access from the interior to the exterior of the bowl mill. The stud bearing means is fixedly mounted within the spring housing means. The preload stud means is suitably supported from the stud bearing means so as to be positioned within the aforementioned opening and such as to extend from the interior to the exterior of the bowl mill. The pressure spring means is positioned in surrounding relation to the preload stud means such that the pressure spring means is housed within the spring housing means so as to be located externally of the bowl mill. The adjustment means detachably secures the spring housing means to the journal opening cover such that adjustments can be effected through the manipulation thereof in the position that the spring housing means bears relative to the journal opening cover.

BRIEF DESCRIPTION OF THIS DRAWING

FIG. 1 is a side elevational view partially in section of a pulverizer bowl mill equipped with a mechanical spring journal assembly constructed in accordance with the present invention; and FIG. 2 is a side elevational view partially in section of a mechanical spring journal assembly constructed in accordance with the present invention.

DESCRIPTION OF A PREFERRED EMBODIMENT

Figure 1:
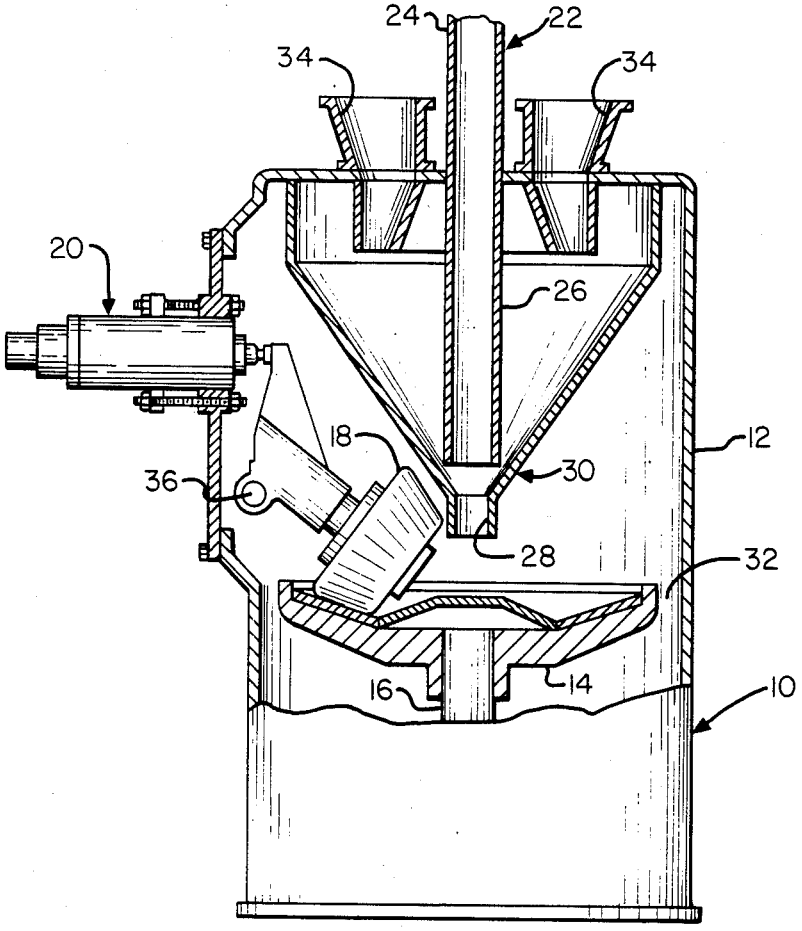

Referring now to the drawing, and more particularly to FIG. 1 thereof, there is depicted therein a pulverizing bowl mill, generally designated by reference numeral 10. Inasmuch as the nature of the construction and the mode of operation of pulverizing bowl mills per se are well-known to those skilled in the art, it is not deemed necessary, therefore, to set forth herein a detailed description of the pulverizing bowl mill 10 illustrated in FIG. 1 of the drawing. Rather, it is deemed sufficient for purposes of obtaining an understanding of a pulverizing bowl mill 10, which is equipped with a mechanical spring journal assembly constructed in accordance with the present invention, that there be presented herein merely a description of the nature of the construction and the mode of operation of the components of the pulverizing bowl mill 10 with which the aforesaid mechanical spring journal assembly cooperates. For a more detailed description of the nature of the construction and the mode of operation of the components of the pulverizing bowl mill 10, which are not described in detail herein, one may have reference to the prior art, e.g., U.S. Pat. No. 3,465,971, which issued on Sept. 9, 1969 to J. F. Dalenberg et. al., and/or U.S. Pat. No. 4,002,299, which issued on Jan. 11, 1977 to C. J. Skalka.

Referring further to FIG. 1 of the drawing, the pulverizing bowl mill 10 as illustrated therein includes a substantially closed separator body 12. A grinding table 14 is mounted on a shaft 16, which in turn is operatively connected to a suitable drive mechanism (not shown) so as to be capable of being suitably driven thereby. With the aforesaid components arranged within the separator body 12 in the manner depicted in FIG. 1 of the drawing, the grinding table 14 is designed to be driven in a clockwise direction.

Continuing with a description of the pulverizing bowl mill 10, a plurality of grinding rolls 18, preferably three in number in accord with conventional practice, are suitably supported within the interior of the separator body 12 so as to be equidistantly spaced one from another around the circumference of the separator body 12. In the interest of maintaining clarity of illustration in the drawing, only one such grinding roll 18 has been shown in FIG. 1. With further regard to the grinding rolls 18, each of the latter as best understood wih reference to FIG. 1 of the drawing is preferably supported on a suitable shaft (not shown) for rotation relative thereto. Further, the grinding rolls 18 are each suitably supported in a manner yet to be described for movement relative to the upper surface, as viewed with reference to FIG. 1, of the grinding table 14. To this end, each of the grinding rolls 18 has a mechanical spring journal assembly, generally designated in FIG. 1 by reference numeral 20, cooperatively associated therewith. Each of the mechanical spring journal assemblies 20 is operative, as will be described more fully hereinafter, to establish a mechanical spring loading on the corresponding grinding roll 18 whereby the latter may be made to exert the requisite degree of force on the coal that is disposed on the grinding table 14 for purposes of accomplishing the desired pulverization of this coal. The manner in which and the means by which the spring loading on the grinding rolls 18 is accomplished by the mechanical spring journal assemblies 20 comprises the subject matter which forms the essence of the present invention, and is described in detail herein subsequently.

The material, i.e., coal, that is to be pulverized in the bowl mill 10 is fed thereto through the use of any suitable conventional type of feeding means such as a belt feeder (not shown). Upon falling free of the belt feeder (not shown), the coal enters the bowl mill 10 by means of a coal supply means, generally designated by reference numeral 22, with which the separator body 12 is suitably provided. In accordance with the embodiment of the pulverizing bowl mill 10 illustrated in FIG. 1, the coal supply means 22 includes a suitably dimensioned duct 24 having one end thereof which extends outwardly of the separator body 12 and preferably terminates in a funnel-like member (not shown). The latter funnel-like member (not shown) is suitably shaped so as to facilitate the collection of the coal particles leaving the belt feeder (not shown), and the guiding thereafter of these coal particles into the duct 24. The other end 26 of the duct 24 of the coal supply means 22 is operative to effect the discharge of the coal onto the surface of the grinding table 14. To this end, as shown in FIG. 1 of the drawing, the duct end 26 preferably is suitably suspended within the separator body 12 through the use of any suitable form of conventional support means (not shown) such that the duct end 26 is coaxially aligned with the shaft 16, and is located in spaced relation to a suitable outlet 28 provided in the classifier, generally designated by reference numeral 30, through which the coal flows in the course of being fed onto the surface of the grinding table 14.

In accord with the mode of operation of pulverizing bowl mills that embody the form of construction depicted in FIG. 1, a gas such as air is utilized to effect the conveyance of the coal from the grinding table 14 through the interior of the separator body 12 for discharge from the pulverizing bowl mill 10. The air provided for this purpose enters the separator body 12 through a suitable opening (not shown) provided therein for this purpose. From the aforesaid opening (not shown) in the separator body 12 the air flows to a multiplicity of annular spaces 32 suitably formed between the circumference of the grinding table 14 and the inner surface of the separator body 12. The air upon exiting from the annular spaces 32 is deflected over the grinding table 14 by means of suitably positioned deflector means (not shown). One such form of deflector means (not shown), which is suitable for use for this purpose in the bowl mill 10 of FIG. 1, comprises the subject matter of U.S. Pat. No. 4,234,132, which issued on Nov. 18, 1980 to T. V. Maliszewski, Jr., and which is assigned to the same assignee as the present application.

While the air is flowing along the path described above, the coal which is disposed on the surface of the grinding table 14 is being pulverized by the action of the grinding rolls 18. As the coal becomes pulverized, the particles are thrown outwardly by centrifugal force away from the center of the grinding table 14. Upon reaching the area of the circumference of the grinding table 14, the coal particles are picked up by the air exiting from the annular spaces 32 and are carried along therewith. The combined flow of air and coal particles is thereafter captured by the deflector means (not shown), which has been referred to previously herein. The effect of this is to cause the combined flow of air and coal particles to be deflected over the grinding table 14. This necessitates a change in direction in the path of flow of this combined stream of air and coal particles. In the course of effecting this change of direction, the heaviest coal particles, because they have more inertia, become separated from the airstream and fall back onto the circumference of the grinding table 14 whereupon they undergo further pulverization. The lighter coal particles, on the other hand, because they have less inertia, continue to be carried along in the airstream.

After leaving the influence of the aforesaid deflector means (not shown), the combined stream of air and coal particles that remain flow to the classifier 30 to which mention has previously been had hereinbefore. The classifier 30, in accord with conventional practice and in a manner which is well-known to those skilled in this art, operates to effect a further sorting of the coal particles that remain in the airstream. Namely, those particles of pulverized coal, which are of the desired particle size, pass through the classifier 30 and along with the air are discharged therefrom and thereby from the bowl mill 10 through the outlets 34 with which the latter is provided for this purpose. On the other hand those coal particles which in size are larger than desired are returned to the surface of the grinding table 14 whereupon they undergo further pulverization. Thereafter, these coal particles are subjected to a repeat of the process described above. That is, the particles are thrown outwardly of the grinding table 14, are picked up by the air exiting from the annular spaces 32, are carried along with the air to the deflector means (not shown), are deflected back over the grinding table 14 by the deflector means (not shown), the heavier particles drop back on the grinding table 14, the lighter particles are carried along to the classifier 30, those particles which are of the proper size pass through the classifier 30 and exit from the bowl mill 10 through the outlets 34.

With further regard to the matter of the pulverizing action to which coal disposed on the upper surface of the grinding table 14, as viewed with reference to FIG. 1, is subjected by the grinding rolls 18, the amount of force that must be exerted by the latter in order to effect the desired degree of pulverization of the coal will vary depending on a number of factors. Simply stated, the amount of force that the grinding rolls 18 must exert in order to accomplish the desired pulverization of the coal can be said to be principally a function of the amount, i.e., depth, of coal that is present on the grinding table 14. In turn, the amount of coal which is disposed on the grinding table 14 is a function of the output rate at which the bowl mill 10 is being operated to produce pulverized coal.

As best understood with reference to FIG. 1 of the drawing, the amount of grinding force which the grinding rolls 18 apply to the coal on the grinding table 14 is a function of the amount of force with which the grinding rolls 18 are biased into engagement with the coal on the table 14. Moreover, in accord with the nature of the construction shown in FIG. 1, the grinding roll 18 depicted therein, which is suitably mounted for rotation on a shaft (not shown), is suitably supported so as to be pivotable about the pivot pin 36 into and out of engagement with the coal that is disposed on the grinding table 14. Although only one grinding roll 18 is shown in FIG. 1 and although this discussion is directed to this one grinding roll 18, it is to be understood that the bowl mill 10 commonly is provided with a plurality of such grinding rolls 18, e.g., preferably three in number, and that this discussion is equally applicable to each of the plurality of grinding rolls 18.

Continuing with the matter of the force exerted by the grinding roll 18, in accord with the nature of the construction illustrated in FIG. 1, the grinding roll 18 is designed to be biased by spring force into and out of engagement with the coal that is on the grinding table 14. More specifically, in accord with the present invention, and as will now be described, the spring force to which the grinding roll 18 is subjected is applied thereto by the mechanical spring journal assembly 20, the nature of the construction and the mode of operation of which comprises the subject matter that forms the essence of the present invention. To this end, the bowl mill 10 embodies a plurality of new and improved mechanical spring journal assemblies 20. That is, in accord with the best mode embodiment of the invention each of the three grinding rolls 18 with which the bowl mill 10 is provided has cooperatively associated therewith a new and improved mechanical spring journal assemblies 20. However, inasmuch as the three mechanical spring journal assembly 20 are each identical in construction and in mode of operation, it has been deemed sufficient for purposes of obtaining an understanding thereof as well as in the interest of maintaining clarity of illustration in the drawing to show only one of the three mechanical spring journal assemblies 20 in FIG. 1 of the drawing.

Figure 2:
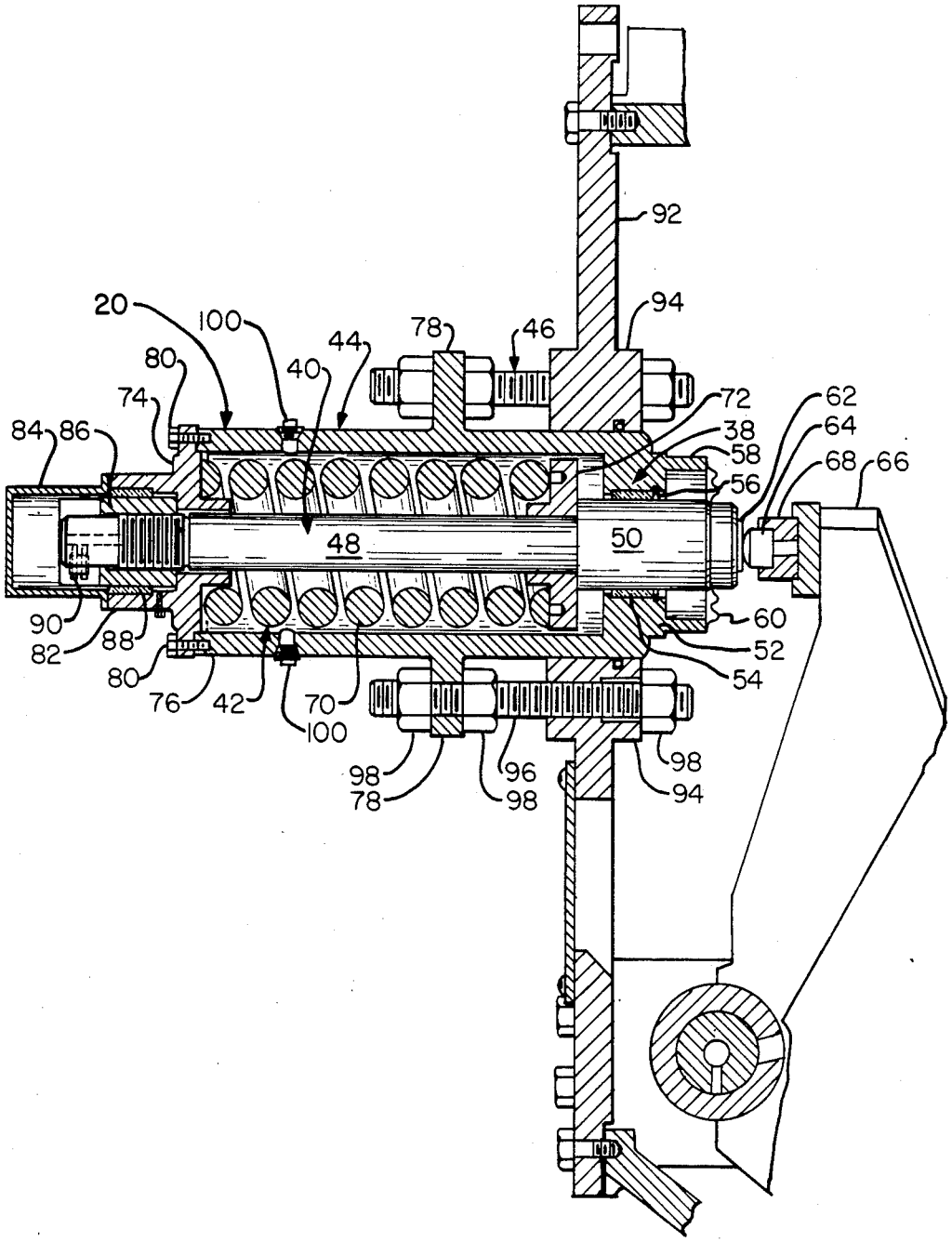

Turning now to a detailed consideration of the nature of the construction of the mechanical spring journal assembly 20, reference will be had for this purpose in particular to FIG. 2 of the drawing. As depicted therein, the mechanical spring journal assembly 20 is seen to include the following major components: a stud bearing means, generally designated by the reference numeral 38; a preload stud means, generally designated by the reference numeral 40; a pressure spring means, generally designated by the reference number 42; a spring housing means, generally designated by the reference numeral 44; and an adjustment means, generally designated by the reference numeral 46.

Commencing first with a description of the preload stud means 40, the latter as best understood with reference to FIG. 2 of the drawing includes a journal pressure spring preload stud which is identified in FIG. 2 by the reference numeral 48. The journal pressure spring preload stud 48 is suitably dimensioned so as to extend substantially the entire length of the mechanical spring journal assembly 20. Moreover, the journal pressure spring preload stud 40 has suitably formed at one end thereof for a purpose which will become more readily apparent from the description that follows an enlarged portion 50. With the journal pressure spring preload stud 48 positioned within the mechanical spring journal assembly 20 in the manner depicted in FIG. 2 of the drawing, the enlarged portion 50 of the journal pressure spring preload stud 48 is designed to protrude outwardly of the mechanical spring journal assembly 20 as will be described more fully hereinafter.

As will be best understood with reference to FIG. 2 of the drawing, the journal pressure spring preload stud 48 is mounted within the spring housing means 44 of the mechanical spring journal assembly 20 such that support for one end of the journal pressure spring preload stud 48 is provided by the stud bearing means 38. To this end, the stud bearing means 38 includes a stud bearing housing, which has been designated in FIG. 2 by the reference numeral 52. Moreover, as seen with reference to FIG. 2, the stud bearing housing 52 is suitably positioned relative to the journal pressure spring preload stud 48 so as to encircle the enlarged portion 50 of the journal pressure spring preload stud 48. More specifically, in accord with the best mode embodiment of the invention, a spring stud bearing assembly, denoted by the reference numeral 54 in FIG. 2, is interposed between the outer surface of the enlarged portion 50 of the journal pressure spring preload stud 48 and the inner surface of the stud bearing housing 52 such that with the stud bearing housing 52 positioned in the manner depicted in FIG. 2 of the drawing, the spring stud bearing assembly 54 through the action of the retaining ring, seen at 56 in FIG. 2, is held captured between the enlarged portion 50 of the journal pressure spring preload stud 48 and the stud bearing housing 52. The stud bearing housing 52 in turn is secured in a manner to which further reference will be had hereinafter to the spring housing means 44 of the bowl mill in any suitable conventional fashion such as by being welded thereto.

Continuing with the description of the mechanical spring journal assembly 20 as shown in FIG. 2 of the drawing, the enlarged portion 50 of the journal pressure spring preload stud 48 further has positioned in encircling relation thereto a seal mounting plate, the latter being identified in FIG. 2 by the reference numeral 58. The seal mounting plate 58 is secured to the stud bearing housing 52 in any suitable conventional fashion such as by being welded thereto. Cooperatively associated with the seal mounting plate 58 is a diaphragm seal, seen at 60 in FIG. 2. To this end, in accordance with the best mode embodiment of the invention the cooperative association of the diaphragm seal 60 with the seal mounting plate 58 is accomplished by means of an assembly consisting of a diaphragm seal outer ring (now shown) and a retainer (not shown). Moreover, the interengagement of the aforereferenced assembly with the diaphragm seal 60 and the seal mounting plate 58 preferably is accomplished through the use of any suitable form of conventional fastening means such as threaded fasteners (not shown).

With reference to FIG. 2 of the drawing, the enlarged portion 50 of the journal pressure spring preload stud 48 is suitably provided at the outermost and thereof with a cavity (not shown). The latter cavity (not shown) moreover is suitably dimensioned so as to be capable of receiving therewithin a spring stud insert, which is to be found identified in FIG. 2 by the reference numeral 62. For purposes of retaining the spring stud insert 62 within the cavity (not shown) any suitable form of conventional fastening means (not shown) may be utilized. The spring stud insert 62 is designed to interact with a journal head insert, seen at 64 in FIG. 2. To this end, the journal head insert 64 is suitably mounted on the journal head, the latter being designated in FIG. 2 by the reference numeral 66, of the bowl mill 10. More specifically, the journal head insert 64 is suitably fastened through the use of any conventional form of fastening means (not shown) to a journal head adapter 68. The journal head adapter 68 in turn is suitably mounted through the use of any conventional mounting means (not shown) on the journal head 66 for movement therewith.

Referring again to FIG. 2 of the drawing, it will be readily apparent therefrom that positioned in surrounding relation to the journal pressure spring preload stud 48 of the preload stud means 40 is the pressure spring means 42. More specifically, the pressure spring means 42 includes a journal pressure spring 70, which as shown in FIG. 2 is designed to encircle the journal pressure spring preload stud 48. In addition, one end of the journal pressure spring 70 is designed to abut against a spring stud adapter identified in FIG. 2 by the reference nuaeral 72, which is suitably dimensioned so as to be positionable on the journal pressure spring preload stud 48 such that the spring stud adapter 72 abuts against a shoulder formed by the enlarged portion 50 of the journal pressure spring preload stud 48. The other end of the journal pressure spring 70 abuts against a spring guide 74, to which further reference will be had hereinafter, that surrounds the journal pressure spring preload stud 48 adjacent the other end of the latter.

The journal pressure spring 70 in turn is suitably housed within the spring housing means 44. Proceeding with a description of the spring housing means 44, as will be best understood with reference to FIG. 2 of the drawing, the spring housing means 44 includes a journal pressure spring housing, the latter being identified by the reference numeral 76 in FIG. 2. Moreover, for a purpose yet to be described the journal pressure spring housing 76 is provided with a plurality of flange portions, two of which can be seen depicted at 78 in FIG. 2, that are suitably formed on the exterior surface of the journal pressure spring housing 76 so as to be suitably spaced along the length of the latter.

Continuing with a description of the spring housing means 44, the journal pressure spring housing 76 as has previously been described hereinbefore has secured thereto in suitable fashion at the right-hand end thereof, as viewed with reference to FIG. 2, the stud bearing means 38. With further reference to FIG. 2, it can be seen therefrom that at the left-hand end thereof, as viewed with reference to FIG. 2, the journal pressure spring housing 76 has secured thereto the spring guide 74. More specifically, the spring guide 74 is secured to the left-hand end, as viewed with reference to FIG. 2, of the journal pressure spring housing 76 through the use of any suitable conventional form of fastening means such as threaded fasteners, two of which can be found depicted in FIG. 2 at 80. As such, it can thus be seen that by virtue of the manner in which the spring guide 74 and the stud bearing means 38 are secured to the opposite ends of the journal pressure spring housing 76, a self-conained assembly is formed. That is, virtually all of the various operating components of the mechanical spring journal assembly 20 are housed within the spring housing means 44 when the latter has secured thereto at the respective ends thereof the spring guide 74 and the stud bearing means 38. Accordingly, an advantageous characteristic of the mechanical spring journal assembly 20 constructed in accord with the present invention is that it is possible to assemble, preload and store the mechanical spring journal assembly 20 as a self-contained unit.

Also provided at the left-hand end, as viewed with reference to FIG. 2, of the journal pressure spring housing 76 is the spring housing cover, which can be found identified in FIG. 2 by the reference numeral 82. In accord with the illustrated embodiment of the invention, the spring housing cover 82 is preferably fastened to the spring guide 74 such as by being welded thereto. Associated with the spring housing cover 82, as will be best understood with reference to FIG. 2, is a spring stud extension cap, the latter being denoted in FIG. 2 by the reference numeral 84. The latter spring stud extension cap 84 is preferably secured to the spring housing cover 82 by means of threaded fasteners (not shown) in conventional fashion.

Encircling the journal pressure spring preload stud 48 at the left-hand end thereof, as viewed with reference to FIG. 2, there is also provided a spring stud locknut 86. For this purpose, the journal pressure spring preload stud 48 at the left-hand end thereof, as viewed with reference to FIG. 2, is preferably provided with threads such that the spring stud locknut 86 in known fashion may be threaded thereon. Further, interposed between the outer surface of the spring stud locknut 86 and the inner surface of the spring housing cover 82 is a spring stud bearing assembly, which has been designated in FIG. 2 by the reference numeral 88. Finally, affixed to the journal pressure spring preload stud 48 at the extreme left-hand end thereof, as viewed with reference to FIG. 2, is a spring stud key (not shown) which in known fashion is maintained properly positioned relative to the journal pressure spring preload stud 48 through the use of the threaded fasteners seen at 90 in FIG. 2.

The mechanical spring journal assembly 20 is mounted relative to the journal opening cover, the latter being denoted in FIG. 2 by the reference number 92, of the bowl mill 10 by means of the adjustment means 46. For this purpose, the journal opening cover 92 is suitably provided with a plurality of bosses, two of which can be seen at 94 in FIG. 2. The actual mounting of the mechanical spring journal assembly 20 to the journal opening cover 92 is accomplished by means of a plurality of adjusting studs seen at 96 in FIG. 2. Each of the adjusting studs 96 is of a suitable length so as to be capable of being made to pass through the flange portions 78 of the journal pressure spring housing 76 as well as the bosses 94 of the journal opening cover 92. Cooperatively associated with each of the adjusting studs 96 is a plurality of nuts 98, the latter being operative to selectively maintain the respective adjusting stud 96 in the proper position once the desired adjustment of the position of the mechanical spring journal assembly 20 relative to the journal opening cover 92 has been accomplished. To this end, the position of the mechanical spring journal opening 20 can be adjusted relative to the journal opening cover 92 through the manipulation of the adjusting studs 96. The need for such adjustment is occasioned by the fact that as the grinding roll 18 wears, engagement must be maintained between the spring stud insert 62 and the journal head insert 64. That is, as the grinding roll 18 wears the journal pressure spring 70 must be made to move closer to the journal head 66.

To complete the description of the nature of the construction of the mechanical spring journal assembly 20, which is the subject of the present invention, the mechanical spring journal assembly 20 has formed in the journal pressure spring housing 76 a plurality of pipe plugs, the latter being seen at 100 in FIG. 2.

A description will now be set forth of the mode of operation of the mechanical spring journal assembly 20, which forms the subject matter of the present invention, in the context of the operation of the bowl mill 10. For this purpose, reference will be had in particular to FIG. 1 of the drawing. As shown in FIG. 1, the mechanical spring journal assembly 20 is suitably mounted by means of the adjustment means 46 on the exterior wall surface of the separator body 12, and in particular on the journal opening cover 92 such that the position thereof relative to the journal opening cover 92 can be adjusted. Within the mechanical spring journal assembly 20, the journal pressure spring 70, as has been described in detail hereinbefore, is suitably supported for expansion and contraction therewithin. Cooperatively associated with the journal pressure spring 70 is the spring stud insert 62, which projects outwardly of the mechanical spring journal assembly 20. The spring stud insert 62 engages the journal head insert 64, which is suitably affixed to the journal head 66. The journal head 66 in turn comprises a portion of the support means for the grinding roll 18. In a manner well-known to those skilled in the spring biasing art, the journal pressure spring 70 through the spring stud insert 62 exerts a spring biasing force on the journal head insert 64 and thereby to the journal head 66.

Accordingly, the engagement of the spring stud insert 62 with the journal head 66 is a function of the force being exerted by the journal pressure spring 70. In turn, the extent to which the spring stud insert 62 is biased into engagement with the journal head insert 64 and thereby with the journal head 66 by the journal pressure spring 70 determines the extent to which the grinding roll 18 is spring biased into engagement with the coal on the grinding table 14, and concomitantly the amount of grinding force being applied to the coal by the grinding roll 18. By way of exemplification, as the coal builds up on the grinding table 14, i.e., under the grinding roll 18, the journal head 70 is caused thereby to rotate in a counterclockwise direction, as viewed with reference to FIG. 1, about the pivot pin 36 which results in an increase in the spring force that is exerted by the mechanical spring journal assembly 20.

With further reference to the mechanical spring journal assembly 20, which forms the subject matter of the present invention, such a mechanical spring journal assembly 20 consists of a completely subassembled unit which can be assembled and preloaded, and even if so desired be stored as a spare part. Moreover, by virtue of the simplified mounting and position adjustment configuration which the mechanical spring journal assembly 20 constructed in accordance with the present invention embodies, all three mechanical spring journal assemblies 20 can be replaced in a bowl mill 10 in the exceedingly short space of four hours. In addition, cost savings have been realized with the mechanical spring journal assembly 20 through the utilization therewithin of a key rather than a locknut keeper, the latter being commonly employed in prior art forms of mechanical coil spring journal loading systems. A further cost savings has been achieved with the mechanical spring journal assembly 20 through the use therein of fewer but larger adjusting studs. Finally, the mechanical spring journal assembly 20 constructed in accord with the present invention is further characterized by the fact that it successfully obviates some of the problems that have seemed to plague coil spring systems embodying earlier forms of construction. By way of exemplification and not limitation, in this regard one such problem known to be associated with at least some earlier designs of spring journal leading systems for bowl mills has been that the spring of one spring system would fail and this in turn would result in imbalanced loading of the grinding rolls of the bowl mill. On the other hand, the mechanical spring journal assembly so constructed in accord with the present invention embodies two major improvements that reduce the possibility that the aforedescribed condition will occur. The first of these resides in the fact that the journal pressure spring 70 employed in the mechanical spring journal assembly 20 of the present invention has been redesigned such as to provide the spring 70 with a much higher factor of safety against failure. Secondly, the mounting position of the journal pressure spring 70 has been moved such that the journal pressure spring 70 in contradistinction to prior art forms of spring journal loading systems is located completely externally of the separator body 12 of the bowl mill 10. A primary benefit of this is that the journal pressure spring 70 is no longer subjected to the operating conditions that exist within the bowl mill 10. Heretofore, in the case of prior art designs of spring journal loading systems for bowl mills, on occasion the heat buildup within the bowl mill would be sufficient to effectuate an annealing of the spring of the spring journal loading system. This annealing in turn would influence the spring's preset and fatigue strength characteristics. However, with the present positioning of the journal pressure spring 70 in accordance with the nature of the construction of the mechanical spring journal assembly 20 of the present invention, the journal pressure spring 70 is suitably located so as not to be exposed to sufficient heat that might otherwise effectuate an annealing of the journal pressure spring 70.

Thus, in accordance with the present invention there has been provided a new and improved assembly operable for establishing the journal loading on the grinding rolls of a bowl mill that is suitable for use to pulverize coal. Moreover, the assembly of the present invention is operative to establish a mechanical spring journal loading on the grinding rolls of a bowl mill that is suitable for use to pulverize coal. In addition, in accord with the present invention, a mechanical spring assembly for establishing the journal loading on the grinding rolls of a bowl mill is provided which is characterized by the fact that the mechanical spring assembly can be furnished in the form of a completely subassembled unit which can be assembled, preloaded and stored as a spare part. Further, the mechanical spring assembly of the present invention for establishing the journal loading on the grinding rolls of a bowl mill is characterized by the fact that the spring portion thereof is suitably positioned such that minimal influence is exerted thereupon by the operating conditions which exist within the bowl mill. Additionally, in accordance with the present invention the mechanical spring assembly for establishing the journal loading on the grinding rolls of a bowl mill is characterized by the fact that the mechanical spring assembly is simpler in construction than prior art forms of mechanical spring journal assemblies. Also, the mechanical spring assembly of the present invention for establishing the journal loading on the grinding rolls of a bowl mill is characterized by the fact that the mechanical spring assembly is easier to employ than prior art forms of mechanical spring journal assemblies. Furthermore, in accord with the present invention a mechanical spring journal assembly has been provided for establishing the journal loading on the grinding rolls of a bowl mill which is characterized by the fact that the mechanical spring assembly is capable of furnishing reliable operation while yet being relatively inexpensive to provide.

While one embodiment of my invention has been shown and described herein, it will be appreciated that modifications thereof, some of which have been alluded to hereinabove, may still be readily made thereto by those skilled in the art. I, therefore, intend by the appended claims to cover the modifications alluded to herein as well as all other modifications which fall within the true spirit and scope of my invention.

What is claimed is:

1. A mechanical spring journal assembly for a bowl mill comprising:

(a) preload stud means including a journal pressure spring preload stud having an enlarged portion formed at one end thereof, said enlarged portion of said journal pressure spring preload stud having a spring stud insert mounted thereon, said spring stud insert being operative to transmit therethrough the spring forces generated by the mechanical spring journal assembly;

(b) spring housing means forming a self-contained subassembly unit for the operating components of the mechanical spring journal assembly, said spring housing means including a journal pressure spring housing, a stud bearing housing and a spring guide, said stud bearing housing being secured to said journal pressure spring housing at one end thereof, said stud bearing housing being operative as an enclosure for some of said enlarged portion of said journal pressure spring preload stud, said spring guide being secured to said journal pressure spring housing at the other end thereof;

(c) spring stud bearing means including a spring stud bearing assembly and a retaining ring, said spring stud bearing assembly being mounted in encircling relation on said enlarged portion of said journal pressure spring preload stud, said retaining ring encircling said enlarged portion of said journal pressure spring preload stud so as to be operative to hold said spring stud bearing assembly captured between said enlarged portion of said journal pressure spring preload stud and said stud bearing housing;

(d) a spring stud adapter supported in encircling relation on said journal pressure spring preload stud so as to be positioned in abutting engagement with said enlarged portion of said journal pressure spring preload stud; and (e) pressure spring means including a journal pressure spring supported within said journal pressure spring housing in encircling relation to said journal pressure spring preload stud, said journal pressure spring having one end thereof in engagement with said spring stud adapter such that said spring stud adapter is operative as one seat for said journal pressure spring, said journal pressure spring having the other end thereof in engagement with said spring guide such that said spring guide is operative as the other seat for said journal pressure spring, said journal pressure spring being operative as the source of the spring bearing forces generated by the mechanical spring journal assembly.

2. The mechanical spring journal assembly as set forth in claim 1 wherein said journal pressure spring housing has formed on the exterior surface thereof a plurality of flange portions.

3. The mechanical spring journal assembly as set forth in claim 2 further including adjustment means operative to adjust the amount of spring force generated by the mechanical spring journal assembly by varying the distance that said spring stud adapter and said spring guide are spaced apart, said adjustment means including a plurality of adjusting studs, each of said plurality of adjusting studs having one end threadedly engaged in a corresponding one of said plurality of flange portions and having the other end accessible from the exterior of the mechanical spring journal assembly.

* * * * *